US011776515B1

(12) United States Patent
Lenz

(10) Patent No.: US 11,776,515 B1
(45) Date of Patent: Oct. 3, 2023

(54) REINFORCED SOLID WOOD BLOCK IDIOPHONE

(71) Applicant: Michael Lenz, Pueblo West, CO (US)

(72) Inventor: Michael Lenz, Pueblo West, CO (US)

( * ) Notice: Subject to any disclaimer, the term of this patent is extended or adjusted under 35 U.S.C. 154(b) by 0 days.

(21) Appl. No.: 17/884,662

(22) Filed: Aug. 10, 2022

(51) Int. Cl.
*G10D 13/08* (2020.01)
*G10D 13/10* (2020.01)
*G10D 13/06* (2020.01)

(52) U.S. Cl.
CPC ..... *G10D 13/08* (2013.01); *G10D 13/06* (2013.01); *G10D 13/10* (2020.02)

(58) Field of Classification Search
CPC ..... G10D 13/08; G10D 13/06; G10D 13/10
See application file for complete search history.

(56) References Cited

U.S. PATENT DOCUMENTS 10,037,747 B1 * 7/2018 Lenz ..... G10D 13/06

OTHER PUBLICATIONS

Website showing prior art idiophones of wood construction: www.pearldrum.com. Screenc aptures of relevent material attached.

* cited by examiner

*Primary Examiner* — Kimberly R Lockett
(74) *Attorney, Agent, or Firm* — Leyendecker & Lemire, LLC

(57) ABSTRACT

A solid wood block idiophone having slit reinforcement plates mounted against the sides of the idiophone's wood block is described. Advantageously, the reinforcement plates act to increase the durability of the wood having one or more open faced resonant chambers with chamber sidewall slits by preventing the wood from fracturing to and from the open woodgrain ends terminated at the sidewall slits.

20 Claims, 4 Drawing Sheets

REINFORCED SOLID WOOD BLOCK IDIOPHONE

BACKGROUND

There are many idiophone instruments that are fashioned from wood, designed to be struck with a mallet or drumstick to produce it's sound. A common instrument is a woodblock that is made from a unitary solid block of wood with a cavity that is cut in from an outside face of the block deep into the wood to form a resonating chamber to enhance and project the sound from the wood vibration caused from striking the block with a drumstick, mallet, or other methods.

An added design element to obtain increased vibration is to add slits from the sidewalls of the resonant chamber to the outside faces of the block, starting from the outside face of the chamber inward along the chamber path a desired distance to obtain a suitable sound when struck. However, when the chamber slits are cut into the sidewalls of the block it creates a durability issue with the solid wood block by cutting through the continuous woodgraining, leaving open woodgrain ends providing a starting and ending point for the wood to split, potentially changing the tone of the idiophone and further causing its failure.

Prior art solutions have been to make the idiophone from materials less prone to cracking such as plastic or laminated woods, such as plywood. However, the sound and tone from these alternatives are often not as desirable as an idiophone made from a solid block of wood.

DETAILED DESCRIPTION

Figure 1:
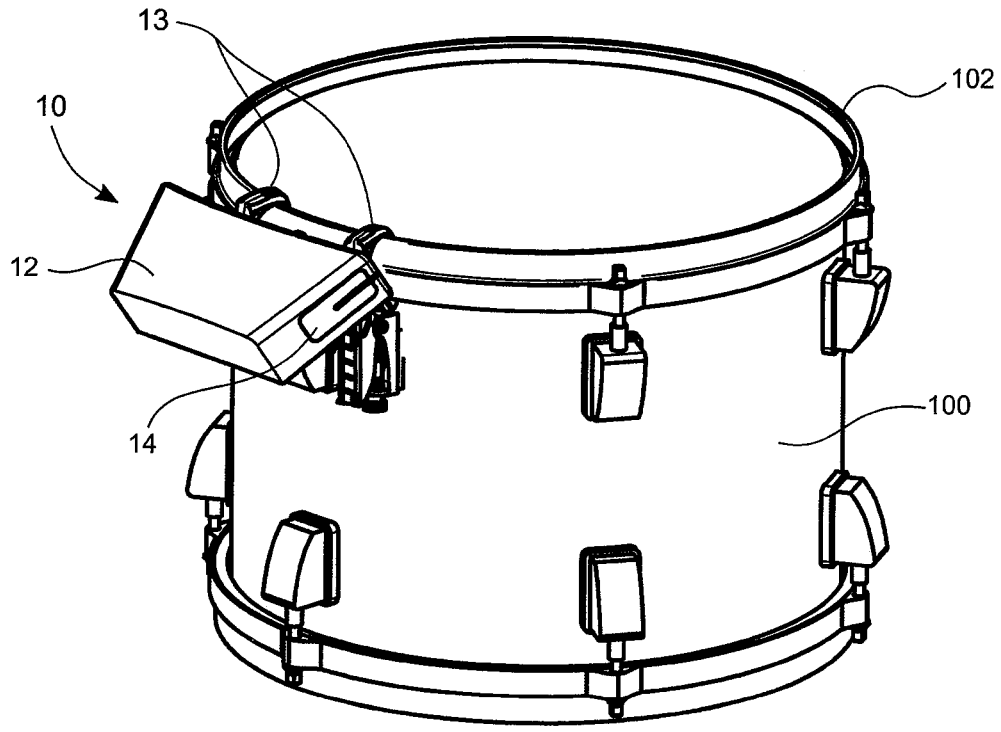
FIG. 1 is an perspective view of a wood block idiophone secured to the rim of a drum according to an embodiment of the present invention.

Embodiments of the present invention comprise a solid wood block idiophone having slit reinforcement plates inlayed into the sides of the idiophone's wood block. Advantageously, the reinforcement plates act to increase the durability of the wood having one or more open faced resonant chambers with chamber sidewall slits by preventing the wood from fracturing to and from the open woodgrain ends terminated at the side wall slits.

In at least some embodiments, a reinforcement plate is attached or molded into an inlayed pocket on the surface of the sidewall having one or more slits therein. Each reinforcement plate includes a corresponding slit in it that when attached to the associated side is similar in size, width, and length to the slit in the underlying wood permitting the wood block to resonate in a manner similar to a similarly configured wood block without reinforcement.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

The phrase "Solid Wood Block", "Solid Block of Wood" and similar phrases used herein refer to the construction and nature of the associated idiophone as comprising a single unitary piece of wood into which a cavity or chamber is formed as opposed to wood blocks that can be comprised of several pieces of wood that have been bonded together, or wood idiophones comprised of wood panels that have been joined to form the sides of a chamber created therefrom.

Figure 2:
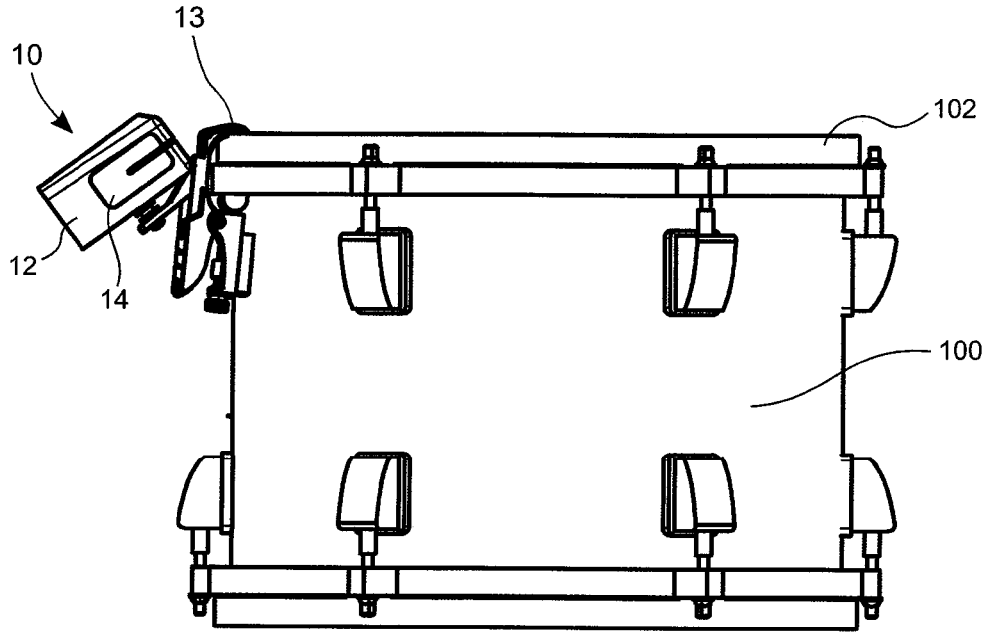
FIG. 2 is a side view of the wood block idiophone secured to the rim of the drum according to the embodiment of the present invention.

The terms "clamp" and "clamps" as used herein refer to any means of attaching an idiophone to another structure whether it is, but not limited to, the rim of a drum, or a drum stand. For instance, the clips used to couple the idiophone to the drum rim in FIGS. 1 & 2 are also considered and referred to as clamps herein.

An Embodiment of a Solid Wood Block Idiophone with Reinforced Sides

Figure 3:
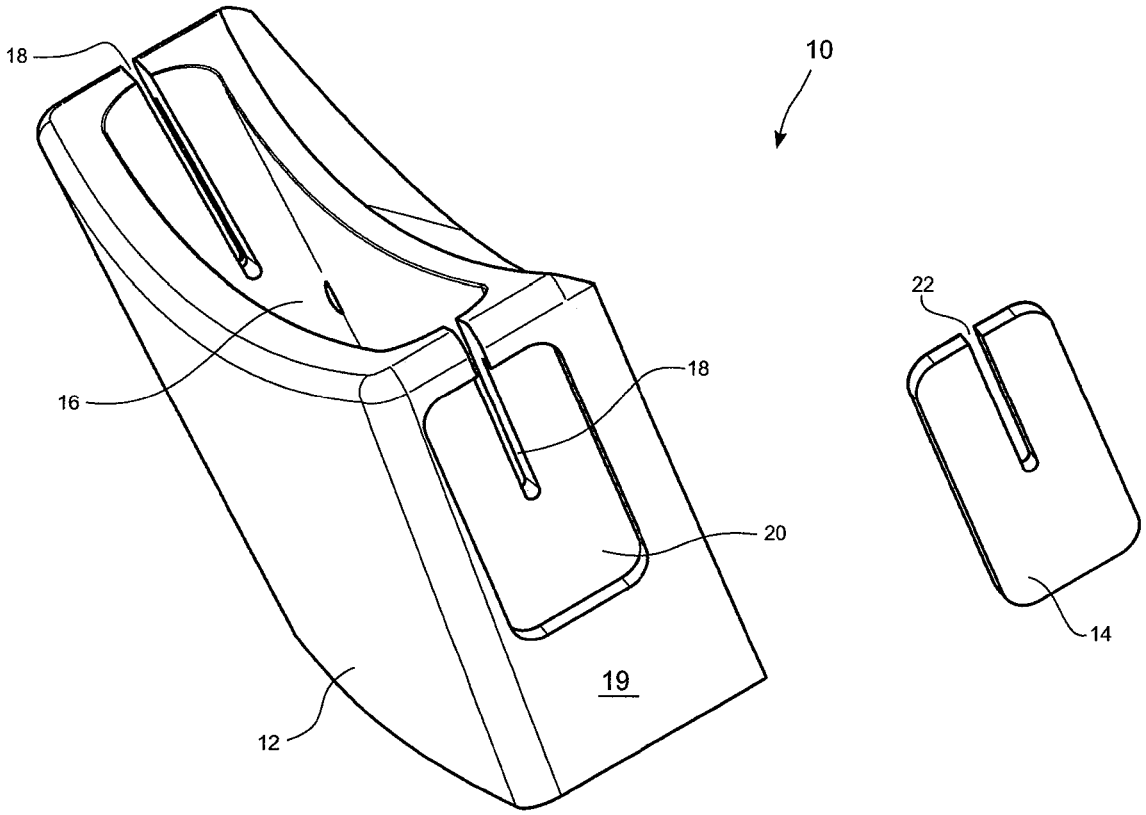
FIG. 3 is a partial exploded perspective view of the wood block idiophone according to the embodiment of the present invention.
Figure 4:
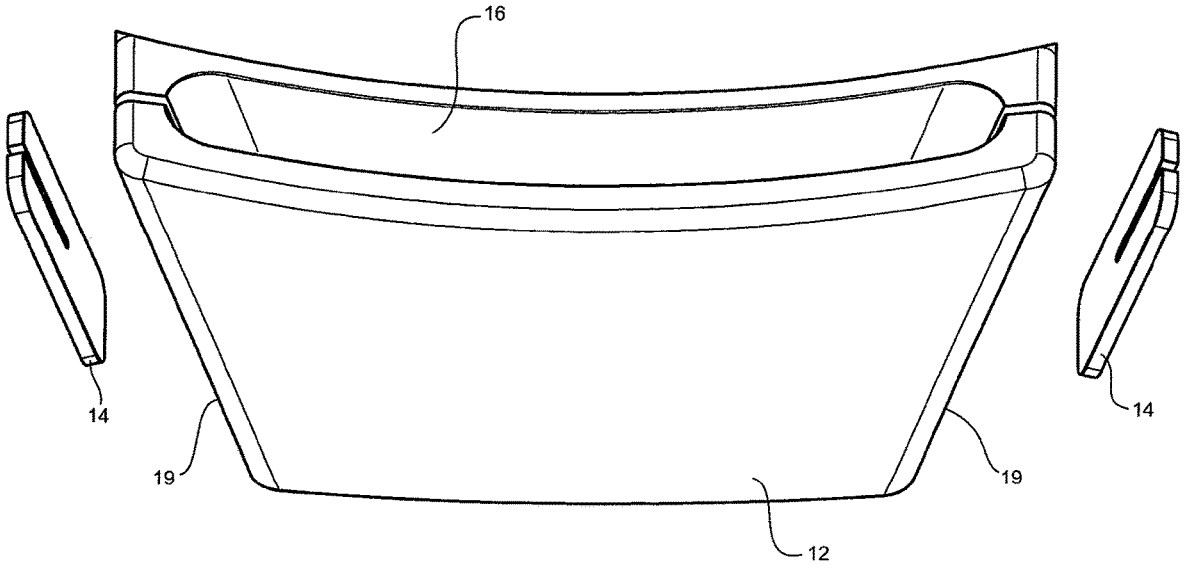
FIG. 4 is an exploded perspective view of the wood block idiophone according to the embodiment of the present invention.
Figure 5:
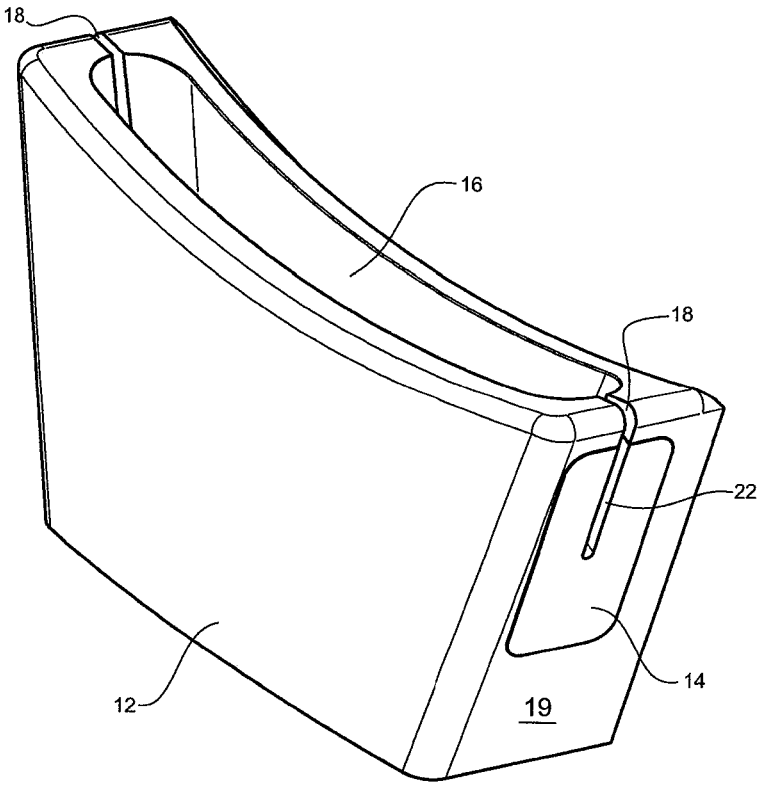
FIG. 5 is a perspective view of the wood block idiophone showing a reinforcement plate received in a recess of a side thereof according to the embodiment of the present invention.

In at least one embodiment of the idiophone as illustrated in FIGS. 3-5, the wood block 12 is made from a solid block of wood that has a cavity cut into the block forming a resonation chamber 16 that enhances the sound waves from the vibration of the wood when struck, producing and projecting an enhanced sound therefrom. To further enhance the vibration of one or more walls surrounding the cavity and consequently the sound produced when struck, the wood block has slits 18 (also referred to as "block slits" herein) cut through the block typically on opposing sidewalls 19 of the resonant chamber. The slits generally start at an opening of the chamber and extend downwardly therefrom until terminating at a location a desired distance above the bottom of the chamber.

The block 12 further includes inlay pockets 20 on the outside faces of the wood block 12 that surround at least some of and typically most of the edges of the slits 18 and importantly surround the bottom ends of the slits. These pockets are designed to receive therein, typically adhesively, reinforcement plates 14. The reinforcement plates further include reinforcement slits 22 that directly overlay the slits 18 of the wood block.

The width, length and depth of the inlay pockets 20, and consequently the reinforcement plates 14 received therein, are determined based on several factors including the material comprising the plates, the size of the wood block, and the size of the slits, but generally in a typical 150 mm by 100 mm wood block idiophone each pocket has a width of about 10 mm to 20 mm, a length of about 30 mm to 50 mm, and a depth of about 1 mm to 3 mm. This leaves an adequate amount of the solid wood between the inlay pocket and the resonant chamber of the woodblock to maintain the natural wood tone when struck as the resonant chamber sidewalls 19 are typically about 8-10 mm thick.

The reinforcement plates 14 can be made from any suitable natural or synthetic material that will bond to the wood block 12 to prevent the wood from splitting apart from the slits 18 while maintaining the sound quality of the solid wood block idiophone when struck. Suitable materials include but are not limited to reinforced and unreinforced plastics, plywood, and metal. They can be constructed from a solid sheet material cut into a pattern for a snug fit into the wood block slit inlay pocket 20 that will bond to the wood block with an adhesive. For example in one variation, the reinforcement plate is constructed from plywood sheeting, from 2 mm to 3 mm thick that is bonded to the wood block with an adhesive. Alternatively the reinforcement plate can be constructed of steel and be much thinner at 0.5-1 mm thick.

The reinforcement plates 14 can also be a formed in situ within the inlay pockets 20 using a liquid or paste resin that will both bond to the wood block and harden into a semi solid or solid material. The resin may be reinforced with carbon, glass, polyethylene, or aramid fibers to enhance its strength and crack inhibiting abilities. For example in another variation, the reinforcement plate is an epoxy resin that fills a 2 to 3 mm deep inlay pocket, bonds to the wood block, and hardens to a solid plate.

As mentioned above, the reinforcement slits 22 correspond with the wood block slits 18 such that they are essentially continuations of the wood block slits. In some variations, the slits 22 in the reinforcement plates 14 and the slits 18 the wood block are separately cut prior to the bonding of the plate in the wood block pocket 20. In other variations, unslit reinforcement plates are either bonded or molded in situ into unslit wood block pockets, and the slits 18 & 22 are cut into the block and the plates simultaneously in a single operation.

FIGS. 1 & 2 provide an illustration of a wood block idiophone 10 attached to the rim 102 of a drum 100. This particular idiophone uses a pair of specially designed clamps 13 to attach it to the drum's rim. This type of idiophone is described in detail in U.S. Pat. No. 10,037,747 and this reference is incorporated herein in its entirety. As can be appreciated, embodiments of a wood block idiophone 10 incorporating the reinforcing plates 14 can be used with a wide variety of mounting fixtures as would be obvious to one of ordinary skill in the art.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. An idiophone comprising:

a solid wood block having (i) a chamber formed therein having at least one open end, (ii) opposing first and second sidewalls defined by the chamber, the first and second sidewalls having respective first and second exterior sidewall surfaces, (iii) first and second block slits extending through the respective first and second sidewalls from the at least one open end extending downwardly therefrom a predetermined distance and terminating at respective first and second slit ends, (iv) first and second inlay pockets formed into the respective first and second sidewalls on the respective first and second exterior sidewall surfaces with the inlay pockets surrounding a substantial portion of the edges of the respective first and second slits including the first and second slit ends; and first and second reinforcement plates received and adhesively secured in the respective first and second inlay pockets, the first and second reinforcement plates having respective first and second reinforcement slits that extend from open end at a top edge of the respective reinforcement plate to a reinforcement slit end proximate a bottom edge of the respective reinforcement plate wherein the first and second reinforcement slits correspond and align with the respective first and second block slits, the reinforcement plate being comprised of a crack resistant material.

2. The idiophone of claim 1, wherein the first and second reinforcement plates are comprised of metal.

3. The idiophone of claim 1, wherein the first and second reinforcement plates are comprised of aluminum.

4. The idiophone of claim 1, wherein the first and second reinforcement plates are comprised of steel.

5. The idiophone of claim 1, wherein the first and second reinforcement plates are comprised of a polymer.

6. The idiophone of claim 1, wherein the first and second reinforcement plates are comprised of epoxy.

7. The idiophone of claim 1, wherein the first and second reinforcement plates are comprised of wood.

8. The idiophone of claim 5, wherein the polymer is reinforced.

9. The idiophone of claim 8, wherein the polymer is reinforced with one or more of glass fiber, carbon fibers, aramid fibers, and polyethylene fibers.

10. The idiophone of claim 5, wherein the reinforcement plates are molded into the inlay pockets in situ.

11. The idiophone of claim 1 including one or more attachment fixtures secured to the solid wood block for securing the idiophone to another structure.

12. The idiophone of claim 11, wherein the one or more attachment fixtures comprise clamps configured to attach to the rim of a drum.

13. A method of making the idiophone of claim 1, the method comprising:

providing a solid wood block blank;

creating the solid wood block by (i) forming the solid wood block blank into a desired exterior shape, (ii) forming the chamber in the solid wood block blank, (iii) forming the first and second inlay pockets in the respective first and second sidewalls, and (iv) forming the first and second block slits in the respective first and second sidewalls; and adhesively attaching the first and second reinforcement plates into the respective first and second inlay pockets.

14. A method of making the idiophone of claim 1, the method comprising:

providing a solid wood block blank;

creating the solid wood block by (i) forming the solid wood block blank into a desired exterior shape, (ii) forming the chamber in the solid wood block blank, (iii) forming the first and second inlay pockets in the respective first and second sidewalls, and (iv) forming the first and second block slits in the respective first and second sidewalls; and adhesively attaching first and second reinforcement plate blanks into the respective first and second inlay pockets, the first and second reinforcement plate blanks comprising first and second reinforcement plates without respective first and second reinforcement slits formed therein; and after adhesively attaching the first and second reinforcement plate blanks, creating the first and second reinforcement plates by forming the respective first and second reinforcement slits.

15. The method of claim 14 wherein said forming the respective first and second reinforcement slits and said forming the first and second block slits in the solid wood block blank is performed simultaneously.

16. A method of making the idiophone of claim 1, the method comprising:

providing a solid wood block blank;

creating the solid wood block by (i) forming the solid wood block blank into a desired exterior shape, (ii) forming the chamber in the solid wood block blank, (iii) forming the first and second inlay pockets in the respective first and second sidewalls, and (iv) forming the first and second block slits in the respective first and second sidewalls; and forming the first and second reinforcement plates in situ by filling the respective first and second inlay pockets with a liquid or paste resin, and thereafter hardening the resin.

17. The method of claim 16, wherein the resin is reinforced with a fibrous reinforcing material.

18. The method claim of 17, wherein the fibrous reinforcing material comprises one or more of long and short fiber glass fibers, carbon fibers, aramid fibers and polyethylene fibers.

19. A method of making the idiophone of claim 1, the method comprising:

providing a solid wood block blank;

creating the solid wood block by (i) forming the solid wood block blank into a desired exterior shape, (ii) forming the chamber in the solid wood block blank, (iii) forming the first and second inlay pockets in the respective first and second sidewalls, and (iv) forming the first and second block slits in the respective first and second sidewalls; and forming the first and second reinforcement plate blanks in situ by filling the respective first and second inlay pockets with a liquid or paste resin, and thereafter hardening the resin, the first and second reinforcement plate blanks comprising first and second reinforcement plates without respective first and second reinforcement slits formed therein; and after forming the first and second reinforcement plate blanks, creating the first and second reinforcement plates by forming the respective first and second reinforcement slits simultaneously with the formation of the respective first and second block slits.

20. An idiophone comprising:

a solid wood block having (i) a chamber formed therein having at least one open end, (ii) opposing first and second sidewalls defined by the chamber, the first and second sidewalls having respective first and second exterior sidewall surfaces, and (iii) first and second block slits extending through the respective first and second sidewalls from the at least one open end extending downwardly therefrom a predetermined distance and terminating at respective first and second slit ends; and first and second reinforcement plates adhesively secured to the respective first and second sidewalls, the first and second reinforcement plates having respective first and second reinforcement slits that extend from open end at a top edge of the respective reinforcement plate to a reinforcement slit end proximate a bottom edge of the respective reinforcement plate wherein the first and second reinforcement slits correspond and align with the respective first and second block slits, the reinforcement plate being comprised of a crack resistant material.

* * * * *